US010110982B2

(12) United States Patent
Miller et al.

(10) Patent No.: US 10,110,982 B2
(45) Date of Patent: Oct. 23, 2018

(54) FABRIC COVER FOR FLEXIBLE NECKBAND

(71) Applicant: Bose Corporation, Framingham, MA (US)

(72) Inventors: Joel H. Miller, Westborough, MA (US); Marcey Ann Mankosa, Boston, MA (US); Michael Andrew Zalisk, Arlington, MA (US); Daniel Winchell Tellier, Pepperell, MA (US); Bojan Rip, Newton, MA (US)

(73) Assignee: BOSE CORPORATION, Framingham, MA (US)

( * ) Notice: Subject to any disclaimer, the term of this patent is extended or adjusted under 35 U.S.C. 154(b) by 26 days.

(21) Appl. No.: 15/411,659

(22) Filed: Jan. 20, 2017

(65) Prior Publication Data

US 2018/0213314 A1 Jul. 26, 2018

(51) Int. Cl.
*H04R 1/10* (2006.01)
*A45C 11/00* (2006.01)
(Continued)

(52) U.S. Cl.
CPC ..... *H04R 1/10* (2013.01); *A45C 11/00* (2013.01); *H04R 1/1041* (2013.01); *H04R 1/345* (2013.01); *A45C 2011/001* (2013.01); *H04R 5/04* (2013.01)

(58) Field of Classification Search
CPC ..... A45C 11/00; A45C 2011/001; H04R 1/10; H04R 1/345; H04R 1/1041; H04R 5/04
See application file for complete search history.

(56) References Cited

U.S. PATENT DOCUMENTS 5,617,477 A * 4/1997 Boyden ..... H04R 3/12 381/309
8,548,381 B2 * 10/2013 Dua ..... G06F 17/30058 455/41.2

(Continued)

FOREIGN PATENT DOCUMENTS

EP 2713629 A1 4/2014

OTHER PUBLICATIONS

International Search Report & Written Opinion in International Patent Application No. PCT/US18/13266, dated Mar. 15, 2018; 16 pages.

(Continued)

*Primary Examiner* — Brian Ensey
(74) *Attorney, Agent, or Firm* — Schmeiser, Olsen & Watts LLP; William G. Guerin

(57) ABSTRACT

A cover for a wearable personal acoustic device includes a fabric cover shaped to receive and enclose a wearable personal acoustic device, and an identification tag, such as an RFID tag or optical tag, secured to the fabric cover. The fabric cover includes a stretchable material that is acoustically transparent. The fabric cover may include a closure mechanism that can provide an opening through which the wearable personal acoustic device is received or removed and a closed state in which the wearable personal acoustic device is enclosed by the fabric cover. The identification tag stores an identifier associated with the fabric cover and communicates with the wearable personal acoustic device through an identification reader. The identifier may be associated with a physical property of the fabric cover or an operational parameter of the wearable personal acoustic device. The operational parameter optionally is definable by a user.

25 Claims, 6 Drawing Sheets

(51) Int. Cl.
*H04R 1/34* (2006.01)
*H04R 5/04* (2006.01)

(56) References Cited

U.S. PATENT DOCUMENTS

| | | | | |
|---|---|---|---|---|
| 8,905,317 | B1 * | 12/2014 | Hsu | G06K 7/10356 235/492 |
| 2007/0230723 | A1 | 10/2007 | Hobson et al. | |
| 2008/0144872 | A1 * | 6/2008 | Phillips | H04R 5/0335 381/333 |
| 2012/0139727 | A1 | 6/2012 | Houvener et al. | |
| 2014/0209690 | A1 * | 7/2014 | Teng | G06K 19/027 235/492 |
| 2015/0195633 | A1 | 7/2015 | Elsasser et al. | |
| 2016/0021449 | A1 | 1/2016 | Litovsky et al. | |
| 2016/0337747 | A1 | 11/2016 | Litovsky et al. | |

OTHER PUBLICATIONS

U.S. Appl. No. 15/041,957, filed Feb. 11, 2016, entitled "Flexible Waveguide Band"; 44 pages.

* cited by examiner

FABRIC COVER FOR FLEXIBLE NECKBAND

BACKGROUND

This disclosure relates to a fabric cover for a flexible neckband. More particularly, the disclosure relates to a fabric cover for a wearable personal acoustic device that includes one or more electro-acoustic transducers in a neckband portion of the device for reproducing audio.

SUMMARY

In one aspect, a cover for a wearable personal acoustic device includes a cover top portion, a cover bottom portion and a closure mechanism. The cover top portion includes a stretchable material that is acoustically transparent. The cover bottom portion includes a seam along which the cover bottom portion is secured to the cover top portion. The closure mechanism is fixed to at least one of the cover top portion and the cover bottom portion. The closure mechanism is configurable between an open state in which an opening is provided through which the wearable personal acoustic device is received between the cover top portion and the cover bottom portion, and a closed state in which the wearable personal acoustic device is enclosed by the cover.

Examples may include one or more of the following features:

The closure mechanism may be a zipper. The closure mechanism may include at least one fastener to secure an edge of the cover top portion to an edge of the cover bottom portion.

The cover may further include an identification tag secured to at least one of the cover top portion and the cover bottom portion. The identification tag is configured to store an identifier associated with the cover and to communicate with a wearable personal acoustic device having an identification reader.

The identification tag may be a radio frequency identification (RFID) tag and the RFID tag may be a near field communication (NFC) tag.

The identifier may be associated with a physical property of the cover and/or an operational parameter for the wearable personal acoustic device. The operational parameter may include at least one parameter to define a frequency characteristic of the wearable personal acoustic device. The operational parameter may include an equalization setting, a sound pressure level, a volume setting and/or filter coefficients.

The cover may further include a cover user interface embedded in at least one of the top cover portion and the bottom cover portion. The wearable personal acoustic device may include a device user interface and the cover user interface may include at least one user selectable interface feature that is configured to be positioned proximate to a device interface feature on the device user interface when the wearable personal acoustic device is enclosed inside the cover.

In accordance with another aspect, a cover for a wearable personal acoustic device includes a fabric cover and an identification tag secured to the fabric cover. The fabric cover is shaped to receive and enclose a wearable personal acoustic device. The fabric cover includes a stretchable material that is acoustically transparent. The identification tag is configured to store an identifier associated with at least one attribute of the fabric cover and to communicate with a wearable personal acoustic device having an identification reader.

Examples may include one or more of the following features:

The cover may further include a closure mechanism fixed to the fabric cover. The closure mechanism is configurable between an open state in which an opening is provided through which the wearable personal acoustic device is received into the fabric cover and a closed state in which the wearable personal acoustic device is enclosed by the fabric cover.

The identification tag may be an RFID tag and the RFID tag may be an NFC tag.

The attribute may include a physical property of the fabric cover and/or an operational parameter for the wearable personal acoustic device. The operational parameter may be definable by a user. The operational parameter may include at least one parameter to define a frequency characteristic of the wearable personal acoustic device.

The identifier may include a link to a remote database storing the at least one attribute.

The fabric cover may include a cover top portion including the stretchable material and further including a cover bottom portion having a seam along which the cover bottom portion is secured to the cover top portion.

In accordance with another aspect, a wearable personal acoustic device includes a neckband, a first acoustic driver, a second acoustic driver, a fabric cover and an identification tag. The neckband is constructed and arranged to be worn around the neck of a user. The neckband includes a housing that includes a first acoustic waveguide having a first sound outlet opening and a second acoustic waveguide having a second sound outlet opening. The first and second acoustic drivers are carried by the housing and are acoustically coupled to the first and second waveguides, respectively. The first sound outlet opening is located proximate to the second acoustic driver and the second sound outlet opening is located proximate to the first acoustic driver. The fabric cover includes a cover top portion that includes a stretchable material that is acoustically transparent and a cover bottom portion that includes a seam along which the cover bottom portion is secured to the cover top portion. The fabric cover further includes a closure mechanism fixed to at least one of the cover top portion and the cover bottom portion. The closure mechanism is configurable between an open state in which an opening is provided through which the wearable personal acoustic device is received between the cover top portion and the cover bottom portion and a closed state in which the wearable personal acoustic device is enclosed by the cover. The identification tag is secured to at least one of the cover top portion and the cover bottom portion, and is configured to store an identifier associated with the cover. The identification tag is further configured to communicate with a wearable personal acoustic device having an identification reader.

Examples may include one or more of the following features:

The identification tag may be an RFID tag and the RFID tag may be an NFC tag.

The identifier may include a physical property of the cover and/or an operational parameter for the wearable personal acoustic device. The operational parameter may include at least one parameter to define a frequency characteristic of the wearable personal acoustic device.

BRIEF DESCRIPTION OF THE DRAWINGS

The above and further aspects of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

Wearable personal acoustic devices can produce sound proximate to the ear of the wearer without blocking ambient sounds. For example, a wearable personal acoustic device may be worn on the shoulders or around the neck of the user. Examples of wearable personal acoustic devices are disclosed in U.S. Patent Publication No. 2016/021449, titled "Acoustic Device," the disclosure of which is incorporated herein by reference in its entirety, and which describes an acoustic device that is generally "U-shaped" and configured to be worn around the neck.

Examples of covers for a wearable personal acoustic device, as disclosed herein, include covers made from a stretchable and acoustically transparent material. The material is preferably non-slip on clothing and bare skin so that the acoustic device remains stable on a wearer under a range of conditions. A cover may include a means to communicate with the acoustic device so that operation of the acoustic device can be dependent on attributes associated with the cover. Communications may be wireless, for example between an identification tag and an identification reader in the acoustic device. In one example the identification tag is a radio frequency identification (RFID) tag on the cover and an RFID reader in the acoustic device. In an alternative example the identification tag is an optical tag on the inside of the cover and the identification reader is an optical reader in the acoustic device. Communications may also be via a physical connector, such as a universal serial bus (USB) connector. This communications capability enables a number of feature improvements described below.

Figure 1A:
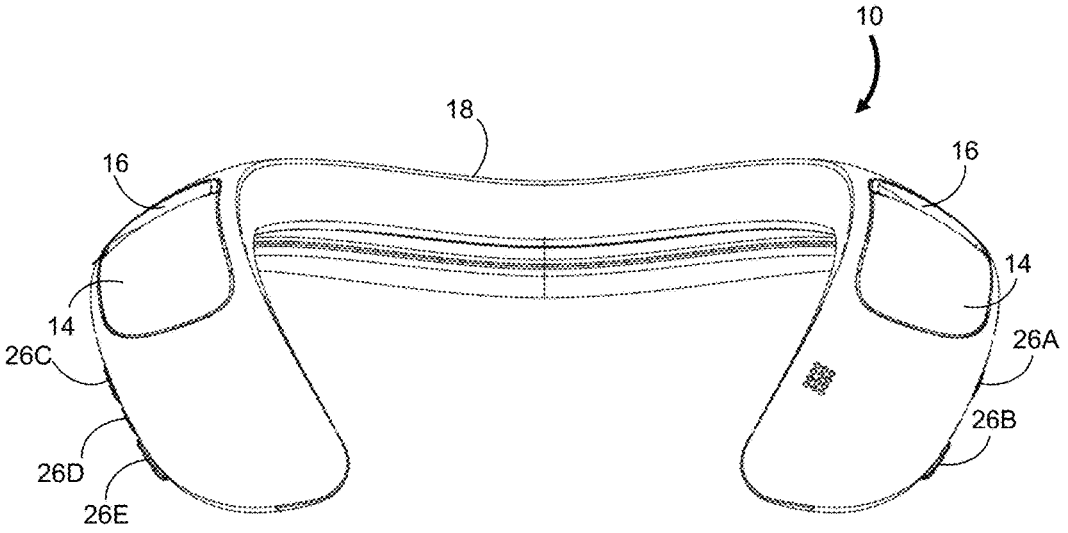
FIG. 1A is a front view of an example of a wearable personal acoustic device.
Figure 1B:
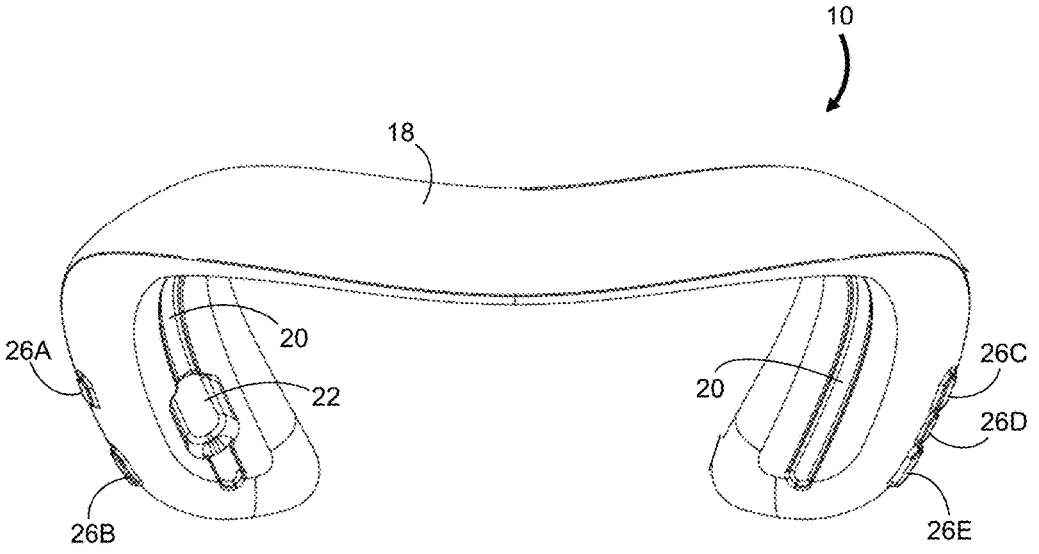
FIG. 1B is a back view of the wearable personal acoustic device of FIG. 1A.
Figure 1C:
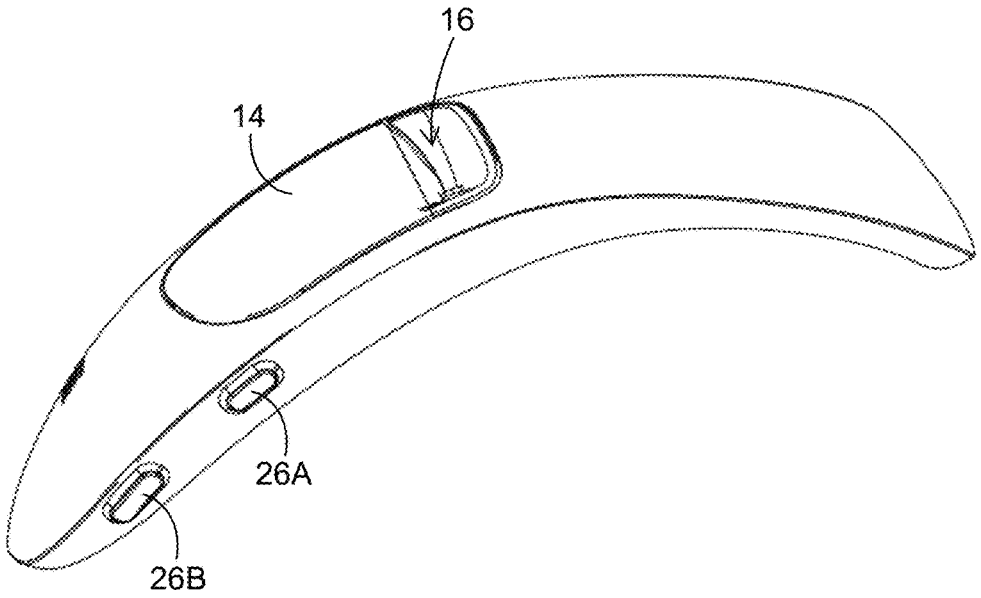
FIG. 1C is an outer side view of one leg of the wearable personal acoustic device of FIG. 1A.
Figure 1D:
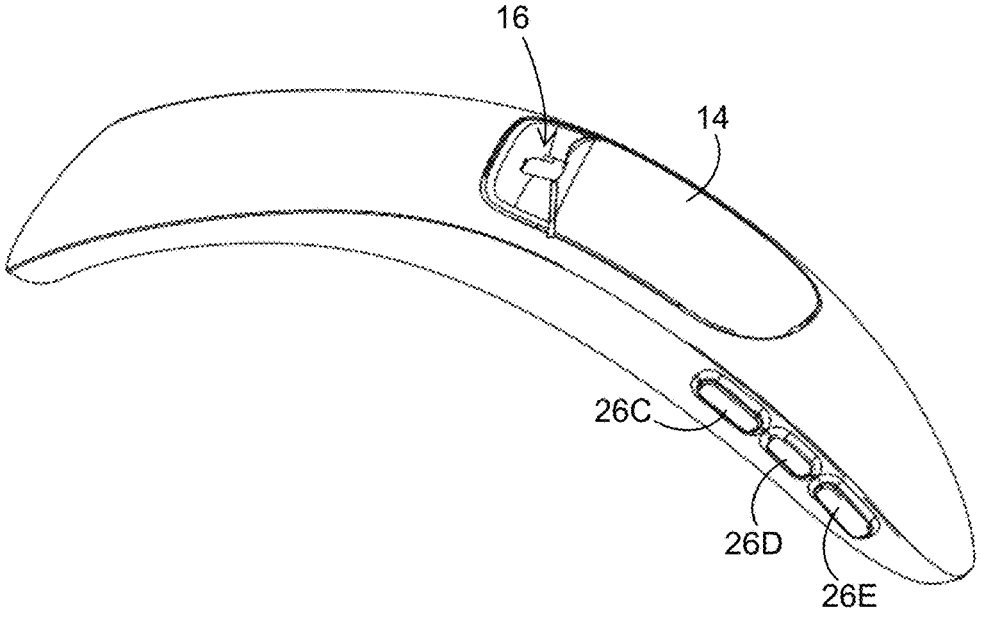
FIG. 1D is an outer side view of an opposite leg to the leg of the wearable personal acoustic device shown in FIG. 1C.

FIG. 1A and FIG. 1B show a front view and a back view, respectively, of an example of a wearable personal acoustic device 10. The acoustic device 10 directs high quality sound to each ear without the need to position acoustic drivers on, over or in the ears. The acoustic device 10 is configured to be worn around the neck and includes a neckband 18 that includes a housing. The neckband 18 has an approximate "U" shape with two legs that, when worn, extend over or near the clavicles and a curved central portion positioned behind the neck. Reference is also made to FIG. 1C and FIG. 1D which show outer side views of the leg that passes over the wearer's left shoulder and the leg that passes over the wearer's right shoulder, respectively. The illustrated acoustic device 10 may have two open-backed acoustic drivers 14; one carried in each leg of the housing. The acoustic drivers 14 are located below the expected locations of the ears of the user and are flush with the outer surface of the housing although in other examples the acoustic drivers 14 may extend outward from the outer surface. The acoustic device 10 also may include two acoustic waveguides inside the housing. Each waveguide may have a sound outlet opening ("exit") 16 below an ear and proximate to one of the acoustic drivers 14. The rear side of one acoustic driver 14 is acoustically coupled to the entrance to one waveguide and the rear side of the other acoustic driver 14 is acoustically coupled to the entrance to the other waveguide. Each waveguide has one end with the acoustic driver that feeds it located below one ear and the other end with the sound outlet opening 16 located below the other ear. While FIGS. 1A-1D show one example of an acoustic architecture that can be used for the wearable personal acoustic device 10, other acoustic architectures are possible, and may include more or fewer acoustic drivers, waveguides or sound outlet openings than shown in FIGS. 1A-1D. The features described herein are applicable to any wearable personal audio device having a fabric cover, regardless of its underlying acoustic architecture.

The neckband 18 may be expanded, straightened, or reshaped to accommodate the comfort of the wearer. The neckband 18 may include a trough 20 and recessed port 22 to receive corresponding features of a closure mechanism on a fabric cover used to enclose the device 10 as described in detail below. Examples of wearable personal acoustic devices having a flexible neckband are disclosed in U.S. patent application Ser. No. 15/041,957, titled "Flexible Waveguide Band," the disclosure of which is incorporated herein by reference in its entirety.

The wearable personal acoustic device 10 includes user interface features such as buttons 26A to 26E (generally 26) to control operation of the acoustic device 10. For example, the buttons 26 may be used to control power and volume, and to select or change an operating mode of the device 10.

Figure 2A:
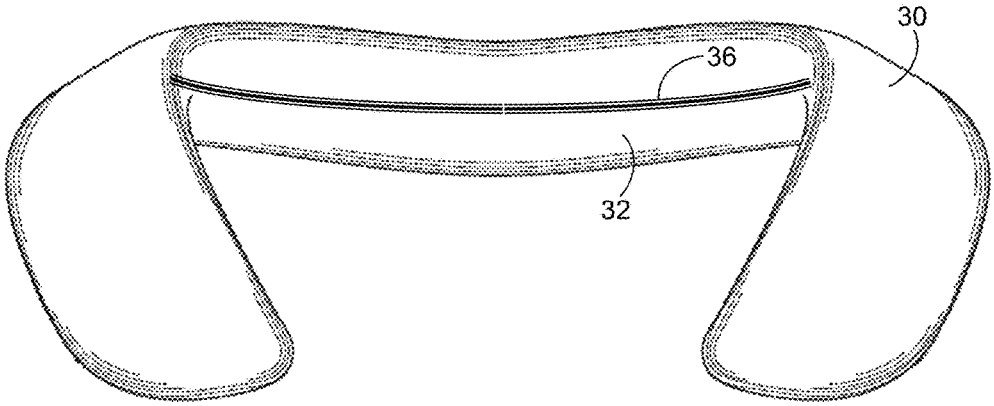
FIG. 2A is an illustration of the wearable personal acoustic device of FIG. 1A enclosed by a fabric cover.
Figure 2B:
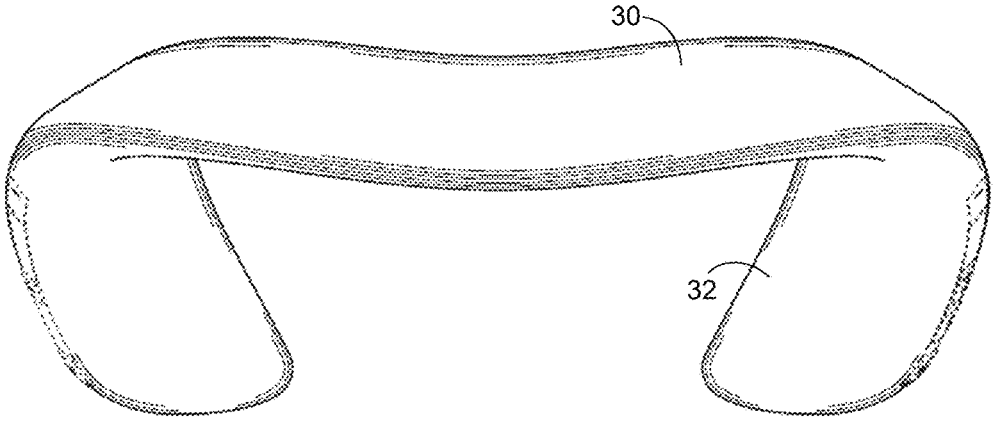
FIG. 2B is an illustration of the wearable personal acoustic device of FIG. 1B enclosed by a fabric cover.

FIG. 2A and FIG. 2B show the wearable personal acoustic device 10 of FIG. 1A and FIG. 1B, respectively, enclosed by a fabric cover. The fabric cover may include a cover top portion 30 and a cover bottom portion 32 that are secured to each other at one or more internal seams. For example, the cover top and bottom portions 30 and 32 may be flat bonded to each other near to and/or along adjacent portion edges using an adhesive film or bonding glue. Alternatively, the top and bottom portions 30 and 32 may be stitched to each other or laser welded. The cover top and bottom portions 30 and 32 may be of different size and shape. For example, the cover top portion 30 may be larger than the cover bottom portion 32 to permit easier donning and doffing of the covered acoustic device.

The cover top portion 30 is preferably fabricated from a stretchable material that is substantially acoustically transparent and may also be visually opaque. As used herein, acoustically transparent means that the material has acoustic impedance that does not perceptibly interfere with the audio playing from the wearable personal acoustic device 10. In one example, the acoustic impedance of the material is equal to or less than approximately 20 Rayls. Visually opaque means that a person cannot sufficiently see through the material to perceive any objects or features on the other side of the material. In one example, the stretchable material is a four-way stretch knit fabric having resistance to pilling. The stretchable material may also be coated to achieve desired characteristics. For example, coatings exhibiting antistatic, hydrophobic and/or fire retardant properties may be used. In one non-limiting detailed example, the stretchable material is a double-pique plain knit formed of 62% polyamide and 38% elastic polyurethane fabric (e.g., Lycra®), and having a weight of 220 g/m$^2$. The cover top portion 30 may have a single (solid) color or may include one or more patterns, images, artwork and/or visual features formed of any number of colors and elemental features. These patterns, images, artwork and/or visual features may be knitted or woven into the cover material and/or formed on the exterior surface of the material.

The cover bottom portion 32 is preferably fabricated from a soft and comfortable material that is flexible, free of sharp edges and can easily be cleaned. Preferably, the cover bottom portion 32 provides sliding friction so that the wearable personal acoustic device 10, when covered, remains substantially in place around the neck of the wearer and therefore reduces or avoids discomfort to the wearer. In one example, the coefficient of friction for the cover material is greater than that of the surface material of the acoustic device 10. In another example, the cover bottom portion 32 is formed from a synthetic leather such as a split leather backing covered with a layer of polyurethane (e.g., "PU leather") that is applied prior to bonding or otherwise fixing the cover portions to each other. The cover bottom portion 32 may be stretchable but does not have to be as stretchable as the cover top portion 30. The cover bottom portion 30 may have a color that is different from the color of the cover top portion 30 and may include one or more patterns, images, artwork and/or visual features similar to or different from the cover top portion 30. In another example, both cover portions are fabricated from the same material.

In some examples, one or both of the cover top and bottom portions 30 and 32 may be made as a stackup of multiple materials. For example, one or more of the materials in the stackup may be a microfiber material.

The materials used for the cover top and bottom portions 30 and 32 are preferably selected for color fastness and ultraviolet (UV) stability, and have material properties that are substantially unchanged by environmental temperature. In addition, the stretchable material is selected to be resistant to puckering, scratching and bunching so that the covered acoustic device is aesthetically pleasing. The cover top and bottom portion materials are substantially unaffected by pilling and abrasion which may result from repeated donning and doffing of the covered acoustic device.

At least one of the top and bottom cover portions 30 and 32 may include, individually or in combination, a cover user interface (UI) to cooperate with some or all the features (e.g., buttons 26) on a UI provided on the housing of the wearable personal acoustic device 10. In one example, the cover UI is a keypad stitched or bonded to one or both cover portions such that buttons on the keypad are registered in position over buttons on the UI of the acoustic device 10 to enable a covered device in a manner similar to that of an uncovered device.

Although the fabric cover is described above as a two piece cover in which a personal wearable acoustic device can be enclosed, in an alternative example the top and bottom cover portions are independently attachable to the acoustic device to substantially enclose the device. In another alternative example, the fabric cover is an integral cover, that is, the fabric cover is a single piece of fabric material with a closure mechanism that allows for insertion and removal of the acoustic device.

Figure 2C:
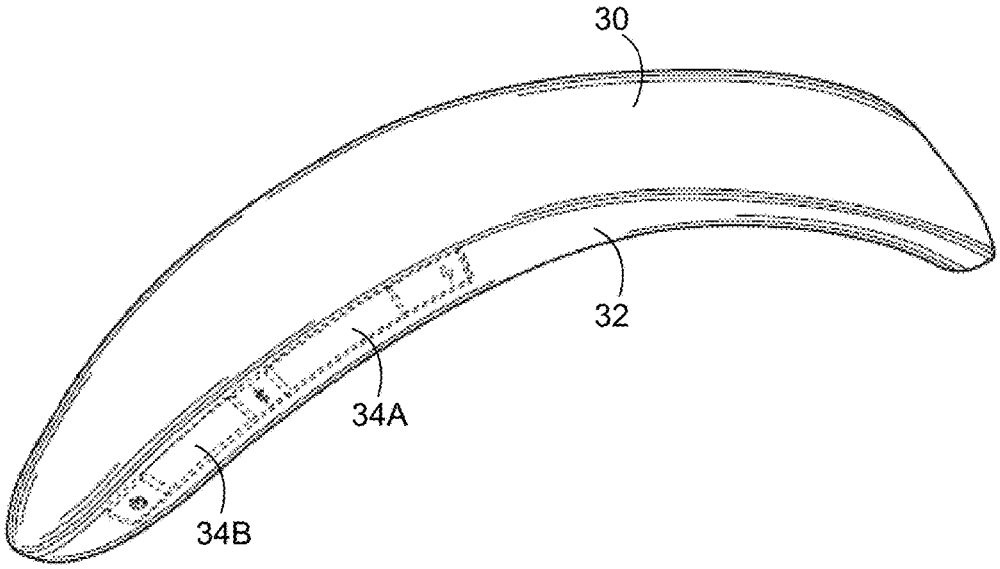
FIG. 2C is an outer side view of the fabric cover that extends over the leg shown in FIG. 1C.
Figure 2D:
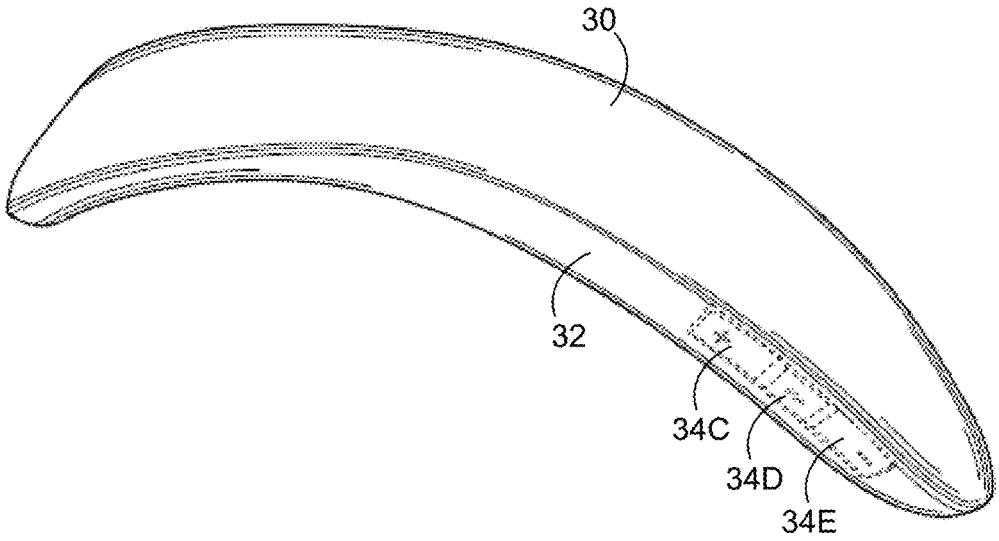
FIG. 2D is an outer side view of the fabric cover that extends over the leg shown in FIG. 1D.

FIG. 2C and FIG. 2D show an outer side view of the fabric cover that extends over the legs shown in FIG. 1C and FIG. 1D, respectively. The cover UI features 34A to 34E (generally 34) are positioned in the cover bottom portion 32 just above the corresponding UI features 26 on the housing of the enclosed acoustic device. The cover features 34 may be visually marked, for example, by a shape or outline having a different color than the cover bottom portion 32. In an alternative example, the cover UI features may be openings in the cover bottom portion 32 that are aligned with the UI features 26 on the acoustic device such that the device UI features (e.g., buttons) protrude through the openings in the fabric cover for direct access by the wearer.

The fabric cover includes a closure mechanism to enclose the personal wearable acoustic device. As used herein, a "closure mechanism" means any mechanism or device that can be fixed to the fabric cover and which can be operated or configured to be in a first (open) state in which an object (e.g., acoustic device 10) may pass into or out from the fabric cover. The closure mechanism can also be operated or configured to be in a second (closed) state in which passage through the closure mechanism is prevented. In the closed state, any object or device previously inserted into the fabric cover through the closure mechanism is substantially surrounded and enclosed by the fabric cover.

By way of non-limiting examples, the closure mechanism can be a zipper or one or more fasteners configured to engage the fabric cover or a complementary fastener. In the illustrated example, a zipper 36 is located on the cover bottom portion 32. The trough 20 in the acoustic device (FIG. 1B) receives the zipper 36 and the recessed port 22 receives the slider (not visible, used to open and close the zipper 36) to increase comfort to the wearer, so the slider is not dangling when not in use. To install the wearable personal acoustic device 10 into the cover, the zipper slider is operated to move to one end of the zipper 36 to thereby separate the parallel rows of zipper teeth. The acoustic device is placed between the cover top and bottom portions 30 and 32, and then the zipper slider is moved to the opposite end of the zipper 36 to fully enclose the acoustic device 10 inside the cover. It will be recognized that other means of enclosing the acoustic device 10 between the cover top and bottom portions 30 and 32 may be used. For example, hook and loop fasteners, such as sections of VELCRO® fastener tape, may be bonded or stitched to the cover portions 30 and 32.

There may be more than one type of fabric cover that may be used with a particular wearable personal acoustic device. For example, a wearer may have a first fabric cover that is intended for everyday use and a second fabric cover that is intended for use during exercise. The second fabric cover may be made from materials that are more resistant to perspiration. Moreover, a wearer may have multiple fabric covers of the same type but with different colors, designs and/or artwork so that the wearer can select for use one of the fabric covers that best suits a specific wardrobe selection.

Different fabric covers may have different acoustic characteristics that affect how sound propagates through the cover. Some fabric covers may be constructed of materials that attenuate sound more. A higher sound pressure level (SPL) may be provided by the acoustic device to compensate for the increased attenuation to achieve the same perceived output volume. In addition, the background environment and acoustic effects encountered during exercise and various sports activities may require a different equalization (EQ) setting from a fabric cover used for everyday use. Thus, it is beneficial for the acoustic device to automatically be "updated" to operate according to the specific requirements of a fabric cover that is used with the acoustic device.

In the following examples, a fabric cover includes an RFID tag or RFID label, which can be used to wirelessly configure proper operation of the acoustic device to address the specific acoustic properties of the cover. It will be recognized that an optical tag and an optical reader can be used in an alternative implementation. In other alternative implementations, a direct electrical connection may be used in lieu of a wireless connection. In these implementations the fabric cover includes at least one connector (e.g., a universal serial bus (USB) connector) configured to couple to a connector on the acoustic device. Such alternative implementations allow the wearable personal acoustic device to be configured in a similar manner to that described below with respect to the RFID tag.

Figure 3:
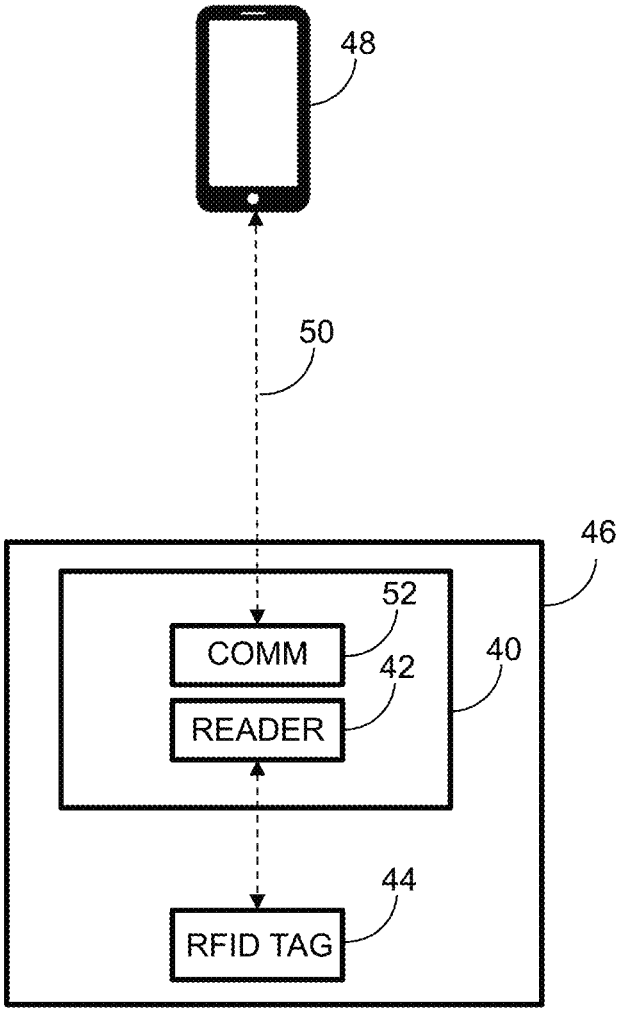
FIG. 3 is a block diagram depicting communications between a wearable personal acoustic device and an RFID tag in a fabric cover, and between a smartphone and the wearable personal acoustic device.

The RFID tag may store one or more of an identifier associated with the cover, at least one attribute of the cover, or acoustic data (e.g., filter coefficients) optimized to control the output of sound through the cover. As used herein, an attribute can be a physical property of the cover (e.g., acoustic impedance), a visual characteristic (e.g., color) and the like. The identifier, acoustic data and/or attribute data can be stored in one or more of the RFID tag, on the personal wearable acoustic device and a remote database. The RFID tag is configured to communicate with an RFID reader on the acoustic device and is disposed, for example, in a pocket provided in the cover top portion 30 or the cover bottom portion 32. The pocket may be sealed at the time of manufacture to permanently enclose the RFID tag. Alternatively, the pocket may be open to allow access to the RFID tag for removal and/or replacement. As used herein, an RFID tag includes various types of tags that can be read with a radio frequency (RF) signal, including near field communication (NFC) tags which are typically smaller and often less expensive than other types of RFID tags. Referring to the example shown in the block diagram of FIG. 3, a wearable personal acoustic device 40 includes an RFID reader 42 that is used to automatically identify the RFID tag 44 when the acoustic device 40 is placed inside a fabric cover 46.

The RFID tag 44 may be passive, active or battery-assisted passive. An active RFID tag has an integrated battery and can periodically transmit its ID signal. A battery-assisted passive RFID tag includes a small battery and is activated when in the presence of an RFID reader, while a passive RFID tag is typically smaller and uses the electromagnetic energy transmitted by the RFID reader for power. The RFID tag 44 typically includes an integrated circuit which can process and store information, modulate and demodulate RF signals, and, for passive tags, acquire DC power from a received RFID reader signal. The circuit can include non-volatile memory for storing the tag information and other data. The tag 44 also includes a miniaturized antenna for receiving and transmitting RF signals.

The RFID tag 44 may be a read-only tag and have an identification number that can be used to reference data in a database. Alternatively, the RFID tag 44 may be a read/write tag such that specific attribute data can be written to the tag by a user. Some RFID tags may be user writeable for a single write event. In some examples, the RFID tag 44 is an NFC tag which is capable of communication with an NFC reader over a range of a few centimeters or less. The NFC frequency may be approximately 13.56 MHz. Preferably, the NFC tag 44 is located on the fabric cover so that the tag 44 is well within the communications operating range of the NFC reader 42 in the wearable personal acoustic device 40 when the device is properly positioned inside the fabric cover.

In the illustrated example, the personal wearable acoustic device 40 communicates with a smartphone 48 over a communications link 50 established between the smartphone 48 and a communications module (COMM) 52 in the acoustic device 40. For example, the communications link 50 may be a wireless link such as a Bluetooth link. In one example, the RFID tag 44 stores an identifier, acoustic data, and/or attribute data used to customize the execution of an application (such as the Bose Connect application available from Bose Corporation in Framingham, Mass.) on the smartphone 48. Alternatively, the identifier, acoustic data, and/or attribute data may be stored on and retrieved from the acoustic device or a remote database (not shown). For example, the identifier, acoustic data, and/or attribute data may control the graphical presentation and/or user interface provided on the smartphone display. Thus, the display may present a personalized representation of the wearable personal acoustic device 40 that includes the actual color and other recognizable features of the fabric cover 46 currently enclosing the acoustic device 40. This visual display of the fabric cover 46 currently enclosing the acoustic device 40 aids the wearer in confirming that the acoustic device 40 is applying the correct operational parameters for the fabric cover, as described further herein.

In one example, a first wearer can configure one or more attributes for the wearable personal acoustic device 40 by writing attribute data to the RFID tag in a first fabric cover or writing the attribute data and associated identifier for the RFID tag to the acoustic device or a remote database. Alternatively, the RFID tag in the first fabric cover may be pre-loaded with an associated identifier, acoustic data, and/or attribute data. When the identifier stored on the RFID tag 44 is read by the RFID reader in the acoustic device 40, attribute data associated with the identifier and preferred by the first wearer are used to change attribute data previously associated with the acoustic device 40. A second (subsequent) wearer can use the same acoustic device 40 with a different (second) fabric cover such that an identifier for an RFID tag 44 in the second fabric cover is read and associated attribute data are used to automatically change at least some of the attribute data of the acoustic device according to the second wearer's preferences. Attribute data that may be changed between or among users according to their respective fabric covers includes operational parameters for the acoustic device. By way of example, the operational parameters may include one or more user-definable parameters such as parameters that define a frequency characteristic (e.g., a desired frequency response) of the acoustic device. Such parameters could include, but are not limited to, equalization ("EQ") settings, spectral profile, frequency response, SPL, volume, and attenuation, and any filter coefficients necessary to control each of these parameters. In another use scenario, the first wearer may have multiple fabric covers each with their own preferred operational parameters. Thus, the first wearer can swap out different fabric covers and use the respective RFID tags in the fabric covers to automatically change at least some of the attribute data of the acoustic device, as described above.

Some attribute data for a fabric cover may be permanently stored on the RFID tag, in the acoustic device or in a remote database. For example, attribute data can be associated with physical properties of the of the fabric cover that do not vary significantly over time such as acoustic impedance and fabric color. Such attribute data can include operational parameter values that are established to compensate for differences in the acoustic output of the wearable personal acoustic device due to differences in the physical properties of different fabric covers. The attribute data may include one or more parameters associated with frequency characteristics (e.g., a desired frequency response) of the acoustic device, such as EQ settings, spectral profile, frequency response, SPL, volume, and attenuation, and any filter coefficients necessary to control each of these parameters, as described above. Optionally, this type of attribute data can be written to the RFID tag as part of the fabric cover manufacture process.

Thus it should be recognized that multiple fabric covers can be used with a wearable personal acoustic device 40. Each fabric cover 46 can configure the acoustic device 40 according to the attribute data associated with the fabric cover 46. This enables different wearers to have a single acoustic device 40 automatically configured according to their personally customized attributes when they use their own fabric cover 46. Moreover, it should be recognized that a fabric cover 46 is not limited to use with a single acoustic device 40. Rather, an individual fabric cover can be used with a different acoustic device to configure it accordingly.

The various examples described above use an RFID tag to convey information from the fabric cover to the wearable personal acoustic device. In alternative examples, an optical tag may be used in lieu of an RFID tag. For example, the optical tag may include a bar code (e.g., linear or on-dimensional bar code), a matrix barcode (two-dimensional bar code) or other form of optical, machine-readable representation of data. The optical tag is formed on or attached to the inner surface of the fabric cover at a location where it is visible to an optical reader in the acoustic device. In one example the optical tag includes a combination of reflective and non-reflective regions. The optical tag is coded with an identifier that is unique to the fabric cover and is associated with the one or more attributes of the fabric cover. Alternatively, the optical tag can be coded with the attributes themselves, or the acoustic data associated with the attributes.

Figure 4:
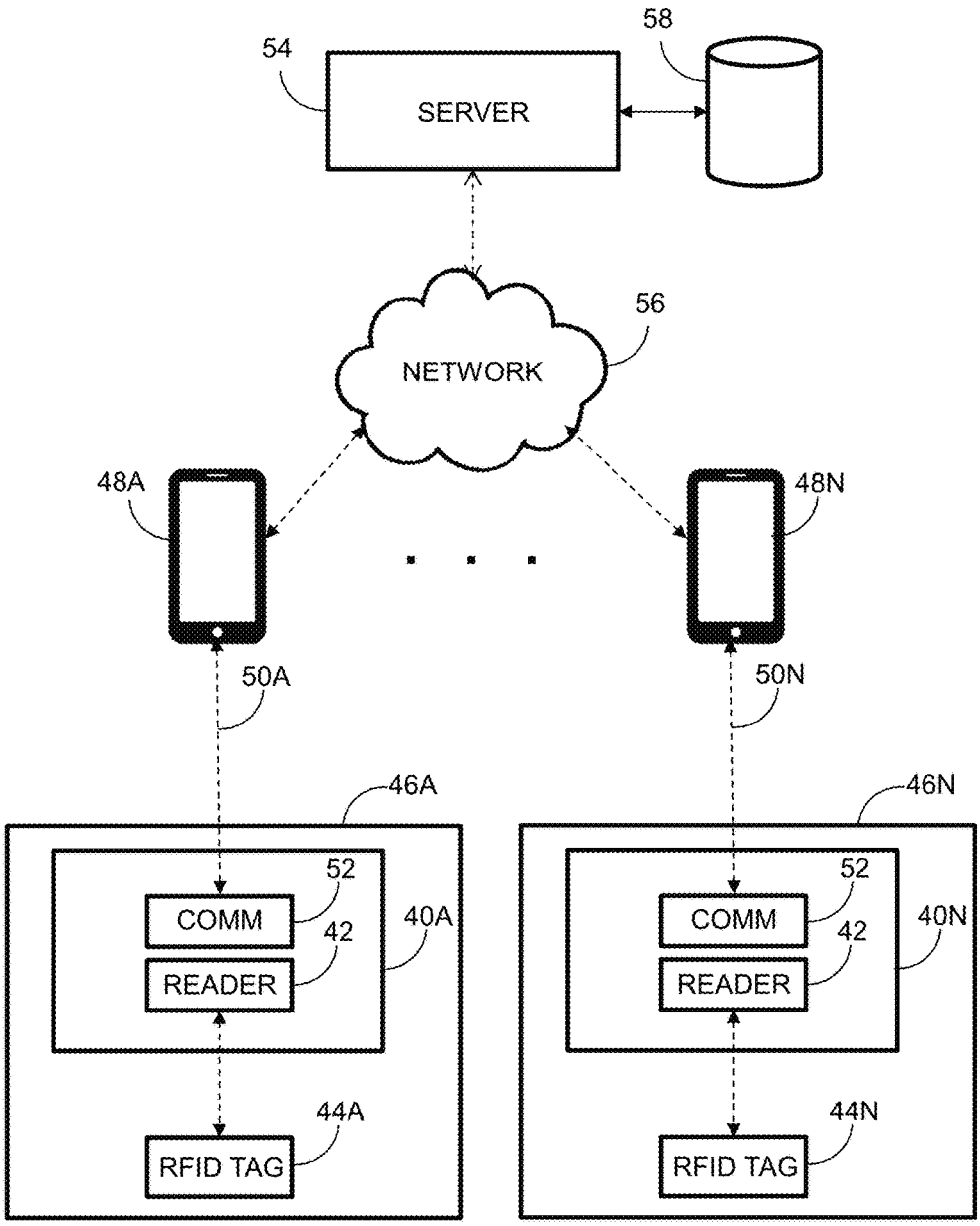
FIG. 4 is a block diagram depicting a communications network used to remotely manage attributes for multiple fabric covers.

Reference is now made to FIG. 4 which is a block diagram illustrating a communications network used to remotely manage attributes for a number of fabric covers 46. The network includes a number N of smartphones 48A to 48N (only two shown for clarity), each in communication over a wireless communication link 50 with a wearable personal acoustic device 40 enclosed within a respective fabric cover 46. The link 50 may be established and maintained according to any one of a variety of protocols, including wireless protocols such as Bluetooth and WiFi. When an acoustic device 40 is inserted in a fabric cover 46, the RFID reader 42 reads a link stored in the associated RFID tag 44. The link may include an address, such as a uniform resource locator (URL), which is used to establish communication with a server 54 over a network 56, such as the Internet, a local area network (LAN) or a wide area network (WAN). The smartphone 48 can then read from a remote database 58 and optionally write to the remote database 58. The database 58 stores attribute data for a population of fabric covers 46. Each smartphone 48 can therefore request and receive any or all attribute data for the fabric cover 46 currently on the respective acoustic device 40. For a given acoustic device 40, the fabric cover 46 may be exchanged for a second fabric cover so that a different wearer can use the device 40 with their preferred settings. In this instance, the identifier for the RFID tag 44 in the second fabric cover is read and used to retrieve the attribute data associated with the second fabric cover from the database 58. In some examples, the database 58 may be accessed through the smartphone 48 via execution of an application (such as the Bose Connect application available from Bose Corporation in Framingham, Mass.) residing on the smartphone 48. Retrieving the relevant attribute data associated with the fabric cover from a remote database enables efficient updating of the attribute data as needed to improve performance of existing fabric cover products or add newly released fabric cover products. When attribute data is retrieved from a remote database, it may be written locally to the acoustic device and/or to the RFID tag in the fabric cover itself to facilitate faster retrieval for future uses of the fabric cover.

In various examples described above, fabric covers are disclosed for flexible neckbands are generally described as having a "U" shape and being worn about the neck and shoulders of a wearer. It will be recognized that the fabric cover can be used with flexible neckbands having other shapes and/or configured for wearing about a different portion of the user's body.

A number of implementations have been described. Nevertheless, it will be understood that the foregoing description is intended to illustrate, and not to limit, the scope of the inventive concepts which are defined by the scope of the claims. Other examples are within the scope of the following claims.

What is claimed is:

1. A cover for a wearable personal acoustic device, comprising:

a cover top portion comprising a stretchable material that is acoustically transparent;

a cover bottom portion comprising a seam along which the cover bottom portion is secured to the cover top portion, the cover top portion and cover bottom portion shaped to receive a wearable personal acoustic device shaped as a neckband; and a closure mechanism fixed to at least one of the cover top portion and the cover bottom portion, the closure mechanism configurable between an open state in which an opening is provided through which the wearable personal acoustic device shaped as the neckband is received between the cover top portion and the cover bottom portion, and a closed state in which the wearable personal acoustic device is enclosed by the cover.

2. The cover of claim 1 wherein the closure mechanism is a zipper.

3. The cover of claim 1 wherein the closure mechanism comprises at least one fastener to secure an edge of the cover top portion to an edge of the cover bottom portion.

4. The cover of claim 1 further comprising an identification tag secured to at least one of the cover top portion and the cover bottom portion, the identification tag configured to store an identifier associated with the cover, the identification tag further configured to communicate with a wearable personal acoustic device having an identification reader.

5. The cover of claim 4 wherein the identification tag is a radio frequency identification (RFID) tag.

6. The cover of claim 5 wherein the RFID tag is a near field communication (NFC) tag.

7. The cover of claim 4 wherein the identifier is associated with at least one of: a physical property of the cover and an operational parameter for the wearable personal acoustic device.

8. The cover of claim 7 wherein the operational parameter comprises at least one parameter to define a frequency characteristic of the wearable personal acoustic device.

9. The cover of claim 7 wherein the operational parameter comprises at least one of: an equalization setting, sound pressure level, volume setting, and filter coefficients.

10. The cover of claim 1 further comprising a cover user interface embedded in at least one of the top cover portion and the bottom cover portion.

11. The cover of claim 10 wherein the wearable personal acoustic device comprises a device user interface and wherein the cover user interface comprises at least one user selectable interface feature that is configured to be positioned proximate to a device interface feature on the device user interface when the wearable personal acoustic device is enclosed inside the cover.

12. A cover for a wearable personal acoustic device, comprising:

a fabric cover shaped to receive and enclose a wearable personal acoustic device, the fabric cover comprising a stretchable material that is acoustically transparent; and an identification tag secured to the fabric cover, the identification tag configured to store an identifier associated with at least one attribute associated with a physical property of the fabric cover, the identification tag further configured to communicate with a wearable personal acoustic device having an identification reader, wherein the operation of the wearable personal acoustic device is configured to operate dependent on the at least one attribute.

13. The cover of claim 12 further comprising a closure mechanism fixed to the fabric cover, the closure mechanism configurable between an open state in which an opening is provided through which the wearable personal acoustic device is received into the fabric cover and a closed state in which the wearable personal acoustic device is enclosed by the fabric cover.

14. The cover of claim 12 wherein the identification tag is a radio frequency identification (RFID) tag.

15. The cover of claim 14 wherein the RFID tag is a near field communication (NFC) tag.

16. The cover of claim 12 wherein the attribute comprises at least one of: a physical property of the fabric cover and an operational parameter for the wearable personal acoustic device.

17. The cover of claim 16 wherein the operational parameter is definable by a user.

18. The cover of claim 16 wherein the operational parameter comprises at least one parameter to define a frequency characteristic of the wearable personal acoustic device.

19. The cover of claim 12 wherein the identifier comprises a link to a remote database storing the at least one attribute.

20. The cover of claim 12 wherein the fabric cover comprises a cover top portion comprising the stretchable material and further comprises a cover bottom portion having a seam along which the cover bottom portion is secured to the cover top portion.

21. A wearable personal acoustic device, comprising:

a neckband that is constructed and arranged to be worn around the neck of a user, the neckband comprising a housing that comprises a first acoustic waveguide having a first sound outlet opening and a second acoustic waveguide having a second sound outlet opening;

a first acoustic driver acoustically coupled to the first waveguide, where the first acoustic driver is carried by the housing;

a second acoustic driver acoustically coupled to the second waveguide, where the second acoustic driver is carried by the housing, wherein the first sound outlet opening is located proximate to the second acoustic driver and the second sound outlet opening is located proximate to the first acoustic driver;

a fabric cover comprising:

a cover top portion comprising a stretchable material that is acoustically transparent;

a cover bottom portion comprising a seam along which the cover bottom portion is secured to the cover top portion; and a closure mechanism fixed to at least one of the cover top portion and the cover bottom portion, the closure mechanism configurable between an open state in which an opening is provided through which the wearable personal acoustic device is received between the cover top portion and the cover bottom portion, and a closed state in which the wearable personal acoustic device is enclosed by the cover; and an identification tag secured to at least one of the cover top portion and the cover bottom portion, the identification tag configured to store an identifier associated with the cover, the identification tag further configured to communicate with a wearable personal acoustic device having an identification reader.

22. The wearable personal acoustic device of claim 21 wherein the identification tag is a radio frequency identification (RFID) tag.

23. The wearable personal acoustic device of claim 22 wherein the RFID tag is a near field communication (NFC) tag.

24. The cover of claim 21 wherein the identifier comprises at least one of: a physical property of the cover and an operational parameter for the wearable personal acoustic device.

25. The cover of claim 24 wherein the operational parameter comprises at least one parameter to define a frequency characteristic of the wearable personal acoustic device.

* * * * *